United States Patent [19]

Mozis et al.

[11] Patent Number: 4,992,768

[45] Date of Patent: Feb. 12, 1991

[54] COW MAGNET

[75] Inventors: Byron G. Mozis; William E. Edmundson, Jr., both of Burnsville, Minn.

[73] Assignee: Power Magnets, U.S.A., Burnsville, Minn.

[21] Appl. No.: 523,385

[22] Filed: May 15, 1990

[51] Int. Cl.[5] ..... H01F 7/02

[52] U.S. Cl. ..... 335/306; 335/302

[58] Field of Search ..... 335/302, 303, 305, 306

[56] References Cited

U.S. PATENT DOCUMENTS 4,283,698 8/1981 Fujisawa ..... 335/306

4,749,978 6/1988 Imamura et al. ..... 335/306 X

FOREIGN PATENT DOCUMENTS 0139409 8/1983 Japan ..... 335/306

*Primary Examiner*—George Harris

*Attorney, Agent, or Firm*—Haugen and Nikolai

[57] ABSTRACT

A cow magnet to be ingested by a ruminant animal comprises a stack of cylindrical permanent magnets having intermediate disk-like spacers of a soft magnetic material where the stack is held together by first and second plastic end cap members with integrally formed tubular sleeves adapted to fit into central bores formed through the cylindrical magnets and spacers with a predetermined friction fit. A pin formed from high carbon steel is then inserted down the center of the tubular sleeves to cause them to expand and tightly engage the side walls defining the central bore formed through the stacked arrangement of magnets and spacers.

5 Claims, 1 Drawing Sheet

COW MAGNET

BACKGROUND OF THE INVENTION

I. Field of the Invention

This invention relates generally to permanent magnets designed to be deposited in a stomach of a ruminant animal, such as a dairy cow, for attracting, collecting and holding sharp ferrous metal objects which may be ingested by the animal during grazing to prevent hardware disease and inhibit sharp objects from passing through the digestive system of the animal. More particularly, the invention pertains to an improved construction of such a permanent magnet device that enhances the magnetic force of attraction of the assembly for a given size and which is better capable of withstanding the harsh environment in which the magnet is used.

II. Discussion of the Prior Art

It is known that when certain ruminant animals are grazing, they will frequently pick up and ingest with their feed bits of metal, such as barb wire, baling wire, nuts and bolts, nails and other metal fragments present in a pasture, stall or feed lot. If such sharp metal objects are allowed to pass through the animal's digestive tract, series injury, hardware disease and even death to the animal can result. It has been the practice for some time now to place one or more permanent magnets in the animal's stomach so that as ferrous metal objects are later ingested by the animal, they will be attracted to the magnet and will adhere thereto rather than passing through the animal's digestive system. In a recent agricultural study, it was found that through consistent installing of cow magnets in diary cows, a 90–98% success rate was achieved in the prevention of hardware disease.

In the Fujisawa Pat. No. 4,283,698, there is described a magnetic device comprising a plurality of cylindrical ceramic magnet segments of cylindrical shape which are arranged in a stacked relationship with one another with adjacent magnetic poles of like polarity adjacent one another and with disks of a soft magnetic steel material interposed therebetween. A longitudinal bore passes through each of the stacked members whereby a first post having a hemispherically-shaped end cap can be inserted through the stack to mate with a second hemispherically-shaped end with the two being joined by a screw-type fastener. A problem has existed with the product made in accordance with the Fujisawa patent. Examination of cow magnets removed from the stomachs of the animals, following slaughter, has revealed that the individual magnetic cylinders and spacers have become detached from one another due to breakage of the plastic center post or failure of the screw threads used to hold the end cap to the mating post.

SUMMARY OF THE INVENTION

The cow magnet of the present invention is deemed to be a significant improvement over the cow magnet described in the Fujisawa patent referenced above. Instead of attempting to hold the stack of cylindrical magnets and spacer disks in their stacked relationship by means of a pair of end caps having a short screw inserted through one end to mate with an opposed plastic post in accordance with the present invention, the end caps and integrally formed tubular posts, which are adapted to fit into the central bores on the cylindrical magnets and spacer disks, themselves have a central bore of a predetermined diameter. A steel pin of relatively soft magnetic properties is forced into the central bore and, in doing so, swells the plastic into strong frictional engagement with the internal diameter of the cylindrical magnetic segments in the intermediate spacer disks. This fastening arrangement has the advantage of not only making a more permanent connection between the stacked pieces but the soft magnetic material of the post is found to enhance the magnetic attraction of the assembly in that magnetic flux lines leaving the ends of the magnetic structure have a low reluctance path back through the center of the assembly.

In its simplest form, the invention comprises a permanent magnet assembly adapted to be located in the reticulum stomach chamber of a ruminant animal and comprises a plurality of cylindrical magnets formed from a pure anisotropic ferrite material, each with a center bore of a predetermined diameter formed through the length dimension thereof, the plural magnets being arranged in a stacked relationship with a plurality of cylindrical spacer members sandwiched between adjacent magnets. The spacer members also include a central bore which allows a pair of molded plastic tubular sleeves to be inserted through the central bore. The outer diameter of the tubular sleeves creates a predetermined interference fit with the stacked arrangement of the magnets and spacer members when inserted into the central bore thereof from opposite ends of the stack. The tubular sleeves also have a central bore and an integrally formed end cap member on one end thereof. Completing the assembly is a cylindrical rod of a length which is slightly less than the stack length and an outer diameter slightly greater than the internal diameter of the bore extending through the tubular sleeves. When the rod is inserted through the central bore of the tubular sleeves following the insertion of the tubular sleeves themselves through the central bores of the stacked arrangement of magnets and spacers, the cylindrical rod expands the tubular sleeves to tightly engage the wall surfaces defining the central bores in the magnets and spacer members. The cylindrical rod is preferably formed from a paramagnetic material providing a low reluctance path for magnetic flux leaving one end of the stacked assembly and entering the other end.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
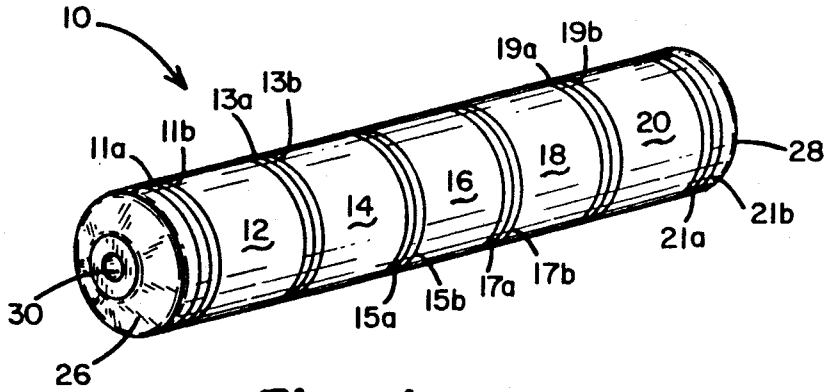
FIG. 1 is a perspective view of a cow magnet in accordance with the present invention.
Figure 2:
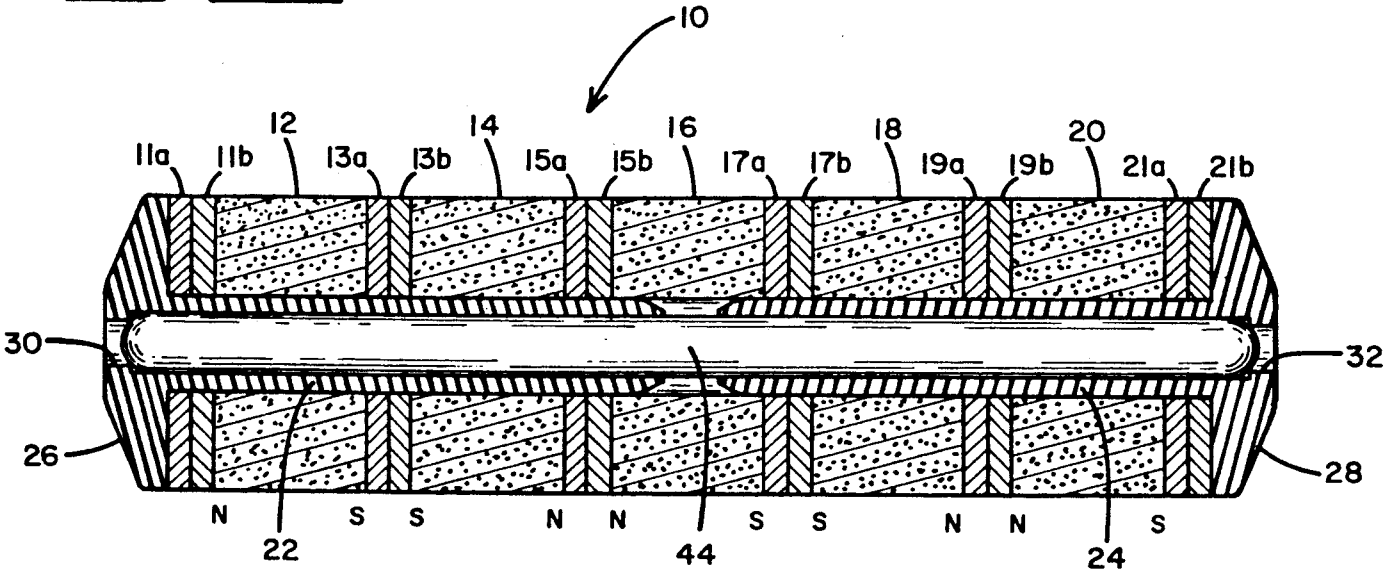
FIG. 2 is a longitudinal cross-sectional view of the cow magnet of FIG. 1.

Referring first to the perspective drawing of FIG. 1, there is indicated generally by numeral 10 a magnet assembly constructed in accordance with the present invention. It is seen to comprise a plurality of cylindrical, tubular ferrite permanent magnet segments 12, 14, 16, 18 and 20 disposed in a stacked relationship with respect to one another and with paired spacers 11*a*, 11*b*, 13*a*, 13*b*, 15*a*, 15*b*, 17*a*, 17*b*, 19*a*, 19*b*, 21*a* and 21*b* sandwiched between adjacent magnets. The magnets 12, 14 . . . 20 are oriented such that like magnetic poles abut one another across the intervening spacers. That is to say, if the magnets are stacked as shown in FIG. 2 such that magnet 12 has the polarity indicated by the north (N)—south (S) convention illustrated, then magnet 14, as well as the remaining magnets will have the polarity indicated by the N and S legends. Stated otherwise, each cylindrical permanent magnet segment is stacked such that each opposes or repels its adjacent neighbor.

The spacers 11*a*, 11*b*, etc. are preferably formed from cold rolled steel and, as such, exhibit a low magnetic remanence. Because of the manner in which the individual magnetic segments are poled and positioned relative to their adjacent spacers, a substantial fringing flux is created at the sites of the spacers, producing a strong magnetic attraction for magnetizable metals that may come within the range of magnetic pull afforded by the magnet.

Next, with reference to the cross-sectional view of FIG. 2, the manner in which the individual cylindrical tubular magnet segments and their intervening spacer disks are held together in stacked relationship will be described. As can be seen, each of the permanent magnet segments 12, 14 . . . 20 has a central longitudinal bore and, similarly, the disk-like spacers 11*a*, 11*b* . . . 21*a*, 21*b* have central apertures and thus resemble a conventional flat washer. When the magnets and associated spacers are stacked, the central bores in each are longitudinally aligned, allowing a pair of identical tubular sleeve members 22 and 24 to be inserted therein. As is better shown in FIG. 3, the members 22 and 24 include integrally molded end caps 26 and 28 which, rather than being hemispherical as in the Fujisawa patent, comprise a truncated cone superimposed on a generally cylindrical base. The end caps 26 and 28 each include a central bore 30 and 32 which extend the full length of the sleeve members 22 and 24, respectively. The outside diameter of the sleeve members 22 and 24 are dimensioned so as to provide an interference fit with respect to the I.D. of the magnetic segments 12 . . . 20 and the spacer rings or washers 11*a*, 11*b* . . . 21*a*, 21*b*.

Figure 3:
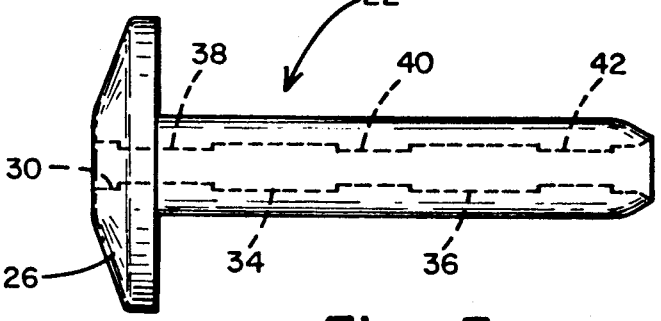
FIG. 3 is a side view of the sleeve member of FIG. 3.

The side elevational view of FIG. 3 shows one of the molded plastic sleeve members 22 or 24 and, as is represented by the hidden lines, the bore 30 therethrough is not of a constant diameter but, instead, is relieved as at 34 and 36 to a slightly larger internal diameter than in the intermediate zones 38, 40 and 42. With reference again to FIG. 2, it will be seen that a steel pin 44 of an outside diameter slightly greater than the internal diameter of the sleeve sections 38, 40 and 42 is forced into the sleeve by being inserted through one or the other of the bores 30 and 32 in the end caps 26 and 28. As the pin is forced through the sleeves, the plastic in the zones 38, 40 and 42 is made to swell and thereby even more rigidly bind the magnet segments and spacer segments. By relieving the internal diameter of the sleeve members as at 34 and 36, surplus plastic from the reduced diameter segment has room to flow, facilitating rod insertion.

Not only does the metal rod serve to firmly hold the magnets and spacers tightly together between the end caps 26 and 28, but also it provides a magnetic return path for flux exiting the end of the magnet labeled "S" and entering the end of the magnet assembly labeled "N". Thus, the use of the metal rod 44 enhances the fringing flux in the zones occupied by the spacer washers 11*a*, 11*b* . . . 21*a*, 21*b* and, therefore, the ability of the magnet assembly to attract metal objects which may be ingested by the animal when grazing. Because the metal rod 44 is of a relatively substantial diameter, it is sufficiently rigid to preclude any bending of the magnet when disposed in the animal's stomach and, thus, the cow magnet is less likely to come apart than those made in accordance with the Fujisawa patent which uses a short, self-tapping screw to join the plastic parts.

While the total length and diameter of the cow magnet, as well as its mass, precludes its passage, as a unit, into the animal's digestive tract, should the fastening means fail, the magnet assembly comes apart and the individual pieces can themselves enter the digestive tract. Therefore, it is important that the magnetic segments and associated spacers remain firmly joined in their stacked relationship throughout prolonged periods of use.

With no limitation intended, and solely for the purpose of disclosing an exemplary embodiment, the various parts may be dimensioned as in the following table:

| ITEM | MATERIAL | LENGTH | WIDTH | I.D. | O.D. |
|---|---|---|---|---|---|
| Magnets 12, 14 . . . 20 | Ceramic | 2.675" | 0.390" | 0.25" | 0.75" |
| Spacers 11a, 11b . . . | CRS | 0.60" | — | 0.256" | 0.740" |
| Sleeve 22 | Polyethylene | 1.270" | — | 0.100"/ 0.120" | 0.24" |
| End Cap 26 | Polyethylene | 0.172"-0.078" | — | 0.100"/ 0.120" | 0.740" |
| Rod 44 | High Carbon Steel | 3" | — | — | 0.130" |

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A permanent magnet assembly adapted to be located in the reticulum stomach chamber of a ruminant animal comprising:

(a) a plurality of cylindrical magnets, each with a center bore of a predetermined diameter formed through the length dimension thereof;

(b) a plurality of cylindrical spacer members, each having an outer diameter generally the same as that of said cylindrical magnets and a center bore generally of the same diameter as said predetermined diameter;

(c) means for maintaining said plurality of magnets and said plurality of spacer members in a stack with at least one of said spacer members interposed between two adjacent cylindrical magnets, said means including:

(i) a pair of molded plastic tubular sleeves of an outer diameter creating a predetermined interference fit when inserted through said center bores of said cylindrical magnets and said spacer members from opposed ends of said stack, said tubular sleeves each having a central bore of a second predetermined diameter and an integrally formed end cap member on one end thereof; and (ii) a cylindrical rod of a length slightly less than the stack's length and an outer diameter greater than said second predetermined diameter, said rod being inserted through said central bores of said tubular sleeves following insertion of said tubular sleeves through said central bores in said plurality of magnets and said plurality of spacer members whereby the insertion of said rod expands said tubular sleeves to tightly engage the wall surfaces defining said central bores in said plurality of magnets and said plurality of spacer members.

2. The permanent magnet assembly as in claim 1 wherein said end caps comprise a truncated cone segment integrally formed with a right circular cylindrical base, said cylindrical base being integrally joined to one end of each of said pair of tubular sleeves.

3. The permanent magnet assembly as in claim 2 wherein the outer diameter of said right circular cylindrical base is generally equal to the outer diameter of said plurality of magnets.

4. The permanent magnet assembly as in claim 1 wherein said cylindrical rod is made from a paramagnetic substance.

5. The permanent magnet assembly as in claim 4 wherein said paramagnetic substance is high carbon steel.

* * * * *